US008783664B2

(12) United States Patent
Arai

(10) Patent No.: US 8,783,664 B2
(45) Date of Patent: Jul. 22, 2014

(54) AUTOMATIC CHOKE APPARATUS FOR CARBURETOR

(75) Inventor: Tetsuya Arai, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 354 days.

(21) Appl. No.: 13/313,552

(22) Filed: Dec. 7, 2011

(65) Prior Publication Data

US 2012/0161341 A1 Jun. 28, 2012

(30) Foreign Application Priority Data

Dec. 28, 2010 (JP) ..... 2010-292947

(51) Int. Cl.

| | |
|---|---|
| ***F02M 1/10*** | (2006.01) |
| ***F02D 41/06*** | (2006.01) |
| ***F02D 9/10*** | (2006.01) |
| *F02D 9/02* | (2006.01) |

(52) U.S. Cl.

CPC ..... *F02M 1/10* (2013.01); *F02D 41/067* (2013.01); *F02D 2009/0249* (2013.01); *F02D 2009/0247* (2013.01); *F02D 9/1025* (2013.01)

USPC ..... 261/38; 261/39.1; 261/42; 261/43; 123/179.18; 123/438

(58) Field of Classification Search

CPC ..... F02M 1/00; F02M 1/02; F02M 1/08; F02M 1/10

USPC ..... 261/38, 39.1, 42, 43, 78.1; 123/179.18, 123/179.19, 438

See application file for complete search history.

(56) References Cited

U.S. PATENT DOCUMENTS

| | | | | |
|---|---|---|---|---|
| 6,752,110 | B2 * | 6/2004 | Tharman et al. | 123/179.18 |
| 2006/0042595 | A1 | 3/2006 | Matsuda | |

FOREIGN PATENT DOCUMENTS

| | | |
|---|---|---|
| DE | 102005040140 | 3/2007 |
| EP | 0221364 | 5/1987 |
| EP | 1630390 | 3/2006 |
| EP | 2128420 | 2/2009 |
| JP | 59-96463 | 6/1984 |
| JP | 2005-282552 | 10/2005 |
| JP | 2006-63864 | 3/2006 |
| JP | 2007-002752 | 1/2007 |
| JP | 2009-264265 | 11/2009 |

OTHER PUBLICATIONS

Japanese Office Action dated May 1, 2013, Application No. 2010-292947, three pages.

* cited by examiner

*Primary Examiner* — Robert A Hopkins

(74) *Attorney, Agent, or Firm* — Rankin, Hill & Clark LLP

(57) ABSTRACT

An automatic choke apparatus for a carburetor includes an electric actuator, a choke valve opening/closing mechanism configured to open and close a choke valve by being driven by a power exerted by the electric actuator, and a controller configured to control operation of the electric actuator. The controller, to which a battery supplies electric power, operates the electric actuator and the choke valve opening/closing mechanism in order that, when the engine is stopped, the choke valve is set in a semi-opened position and, when the engine starts to be cranked, the choke valve is set in a fully-closed position. Accordingly, it is possible to prevent the choke valve from freezing up in the fully-closed state in a case where the engine is stopped under an extremely low temperature environment.

8 Claims, 8 Drawing Sheets

AUTOMATIC CHOKE APPARATUS FOR CARBURETOR

BACKGROUND OF THE INVENTION

1. Field of the Invention

The present invention generally relates to an automatic choke apparatus for a carburetor and, more particularly, to an automatic choke apparatus for a carburetor that is suitable for use in a general-purpose engine.

2. Description of the Related Art

Japanese Patent Application Laid-open No. 2007-2752 teaches an automatic choke apparatus for a carburetor that is designed to drive a choke valve to open and close using power exerted by an electric actuator.

Meanwhile, the automatic choke apparatus for a carburetor, which is disclosed by Japanese Patent Application Laid-open No. 2007-2752, sets the choke valve into a fully-closed state when the engine is stopped. For this reason, the valve shaft of the choke valve may freeze up in the fully-closed state when the automatic choke apparatus is used on a carburetor of a general-purpose engine installed in snowplow trucks and the like, which are used in an extremely low temperature, high humidity environment. If the engine is started in such a state, the amount of air becomes smaller than needed immediately after the engine is started, and the revolutions of the engine do not increase. For this reason, the engine stalls when a load is applied to the engine. This adversely affects the marketability.

SUMMARY OF THE INVENTION

The present invention has been made with the foregoing situation taken into consideration. The present invention is directed toward providing an automatic choke apparatus that prevents a choke valve from freezing up in a fully-closed state when an engine is stopped in an extremely low temperature environment.

According to a first feature of the present invention, an automatic choke apparatus for a carburetor includes an electric actuator, a choke valve opening/closing mechanism configured to open and close a choke valve by being driven by a power exerted by the electric actuator, and a controller configured to control operation of the electric actuator. The automatic choke apparatus also includes a battery configured to supply electric power to the controller and the electric actuator. The controller operates the electric actuator and the choke valve opening/closing mechanism such that the choke valve is set in a semi-opened position when an engine is stopped and the choke valve is set in a fully-closed position when the engine starts to be cranked.

With the first feature of the present invention, the choke valve is set in the semi-opened position when the engine is stopped, and in the fully-closed position when the engine starts to be cranked. For this reason, even if a valve shaft of the choke valve freezes up while the engine is being stopped (i.e., in the semi-opened position), the amount of air does not become smaller than needed immediately after the engine is started, and the engine stall is avoided. Accordingly, the marketability can be enhanced.

According to a second feature of the present invention, in addition to the first feature, the automatic choke apparatus for a carburetor further includes a throttle valve opening/closing mechanism configured to open and close a throttle valve in accordance with operation of the electric actuator, and provided between the electric actuator and the throttle valve. The choke valve opening/closing mechanism includes, as one component, a cam provided to an operation member constituting a part of the throttle valve opening/closing mechanism, and is provided between the operation member and the choke valve. The cam is formed such that, while the engine is being warmed up, the choke valve is operated between the fully-closed position and the semi-opened position, in accordance with an opening degree of the throttle valve.

With the second feature of the present invention, the electric actuator is commonly used between the throttle valve opening/closing mechanism for opening and closing the throttle valve and the choke valve opening/closing mechanism. For this reason, it is possible to reduce the number of parts, and to build the automatic choke apparatus in a compact size. Further, the choke valve opening/closing mechanism operates the choke valve between the fully-closed position and the semi-opened position in accordance with an opening degree of the throttle valve while the engine is being warmed up. For this reason, the engine can be started in a satisfactory condition by matching the opening degree of the choke valve with the opening degree of the throttle valve while the engine is being warmed up.

According to a third feature of the present invention, in addition to the first or second feature, the automatic choke apparatus for a carburetor further includes a thermo-actuator configured to drive the choke valve toward an open side in accordance with ambient temperature independently of the choke valve opening/closing mechanism.

With the third feature of the present invention, the choke valve is driven toward an open side by the thermo-actuator in accordance with the ambient temperature. For this reason, the opening degree of the choke valve can be adjusted in accordance with the ambient temperature, and the engine can be started in accordance with the external environment.

According to a fourth feature of the present invention, in addition to any one of the first to third features, the automatic choke apparatus for a carburetor further includes a relief mechanism configured to rotate the choke valve toward an open side in accordance with a sharp increase in load while the choke valve is between the fully-closed position and the semi-opened position.

With the fourth feature of the present invention, the relief mechanism rotates the choke valve toward an open side if the load sharply increases when the choke valve is set between the fully-closed position and the semi-opened position. For this reason, the air-to-fuel ratio can be adjusted in accordance with the load.

According to a fifth feature of the present invention, in addition to any one of the first to fourth features, the automatic choke apparatus for a carburetor further includes a choke valve forcedly-closing device that enables the choke valve to be rotated toward a close side through manual operation from outside the carburetor.

With the fifth feature of the present invention, the choke valve can be rotated toward a close side by use of the choke valve forcedly-closing device. For this reason, even if the valve shaft of the choke valve freezes up with the choke valve being semi-opened, the valve shaft can be released from its freeze-up state by forcedly rotating the choke valve toward a close side.

The above and other objects, characteristics and advantages of the present invention will be clear from detailed descriptions of the preferred embodiment which will be provided below while referring to the attached drawings.

DESCRIPTION OF THE PREFERRED EMBODIMENT

Figure 1:
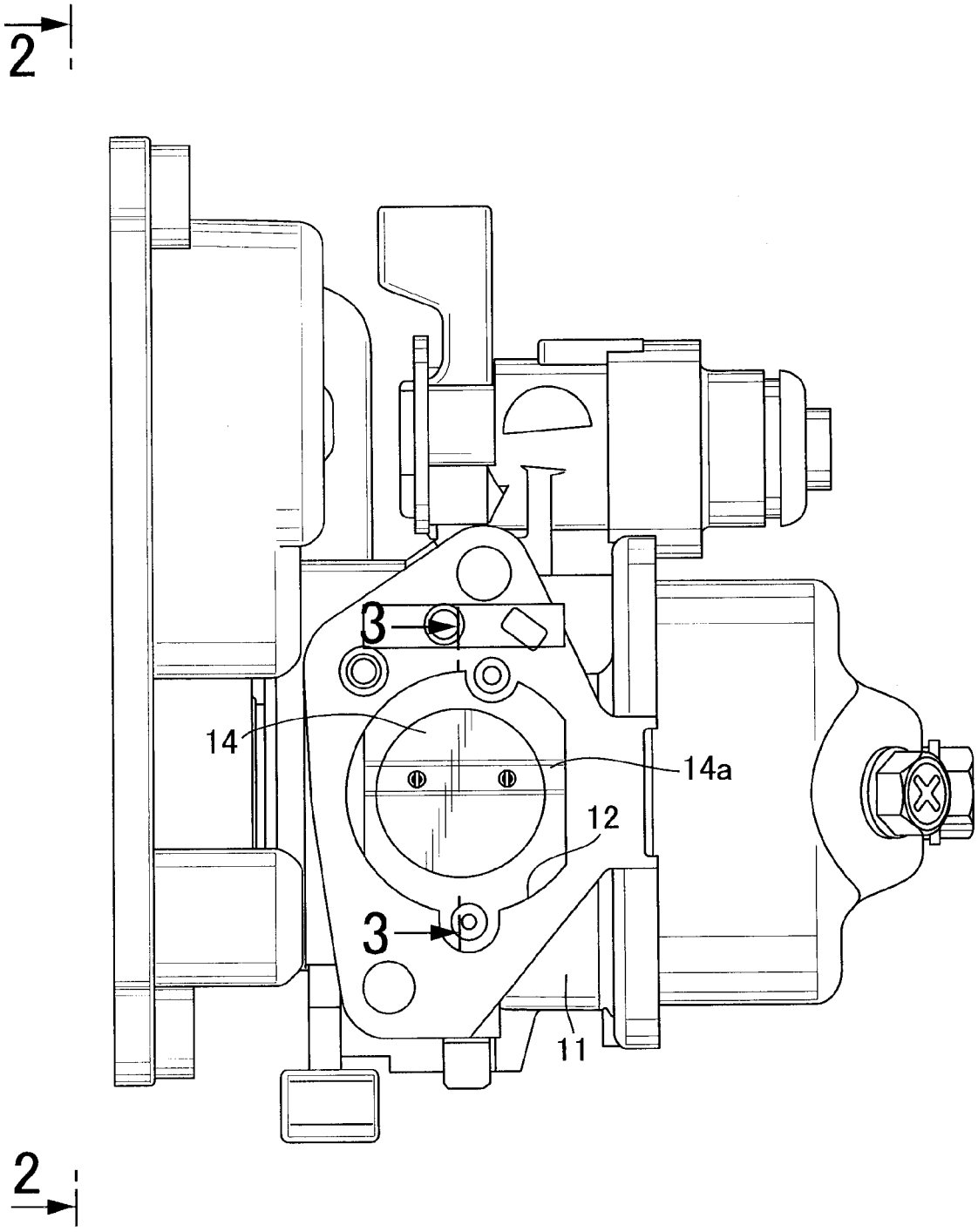
FIG. 1 is a front view of a carburetor while an engine is stopped, and is a view seen from a direction indicated by an arrow 1 in FIG. 2.

Descriptions will be hereinbelow provided for an embodiment of the present invention while referring to the attached drawings. First of all, in FIGS. 1 to 3, the carburetor is for a general-purpose engine to be mounted on a snowplow truck or the like, which is used in an extremely low temperature, high humidity environment, and, from the upstream side in an air intake direction 13, a butterfly-type choke valve 14 and a butterfly-type throttle valve 15 are placed, in this order, in an air intake path 12 provided in a carburetor main body 11. The choke valve 14 is fixedly attached to a choke valve shaft 14*a* which is rotatably supported by the carburetor main body 11 in a way that makes the choke valve shaft 14*a* traverse the air intake path 12. The throttle valve 15 is fixedly attached to a throttle valve shaft 15*a* which is rotatably supported by the carburetor main body 11 in a way that makes the throttle valve shaft 15*a* traverse the air intake path 12.

Figure 2:
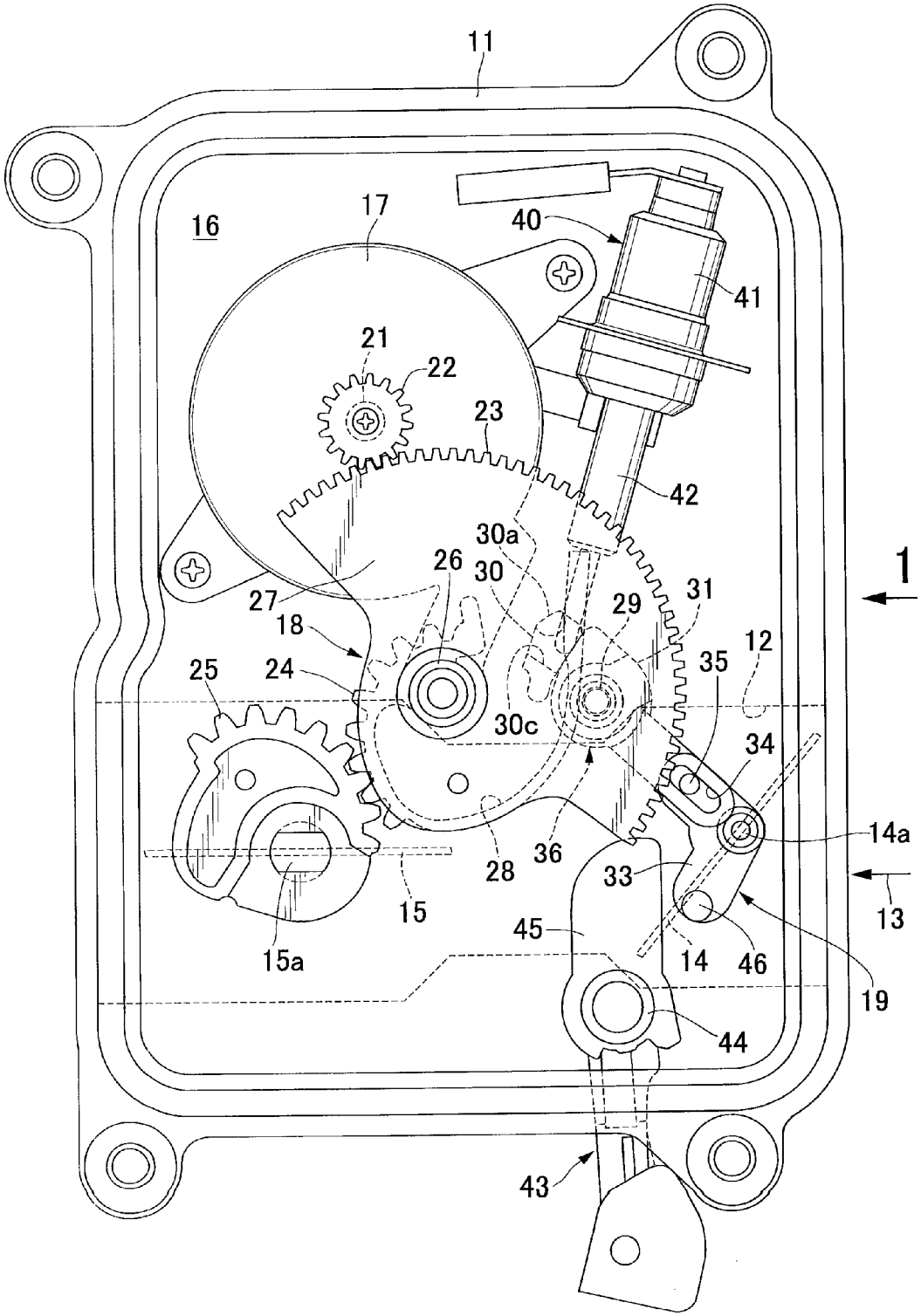
FIG. 2 is a side view seen from a line 2-2 in FIG. 1.

As shown in FIG. 2, the carburetor main body 11 is provided with an accommodation recess 16, which is arranged at a side of the air intake path 12, in a way that makes the accommodation recess 16 opened toward a lateral surface of the carburetor main body 11. An open end of the accommodation recess 16 is closed by a lid member (not illustrated), which is detachably attached to the carburetor main body 11.

An electric motor 17, a throttle valve opening/closing mechanism 18, and a choke valve opening/closing mechanism 19 are accommodated in the accommodation recess 16. The electric motor 17 serves as an electric actuator. The throttle valve opening/closing mechanism 18 is provided between the electric motor 17 and the throttle valve shaft 15*a* of the throttle valve 15 in a way that makes the throttle valve opening/closing mechanism 18 open and close the throttle valve 15 in accordance with the operation of the electric motor 17. The choke valve opening/closing mechanism 19 is driven by a power exerted by the electric motor 17, and opens and closes the choke valve 14.

The electric motor 17 is accommodated in and fixed to the inside of the accommodation recess 16 with a motor shaft 21 of the electric motor 17 situated in parallel with an axis of the choke valve shaft 14*a* and an axis of the throttle valve shaft 15*a*. In addition, the throttle valve opening/closing mechanism 18 includes a drive gear 22 provided to the motor shaft 21 of the electric motor 17, a first idle gear 23 in mesh with the drive gear 22, a second idle gear 24 configured to rotate integrally with the first idle gear 23, and a driven gear 25 fixedly attached to the throttle valve shaft 15*a*, and in mesh with the second idle gear 24. The first and second idle gears 23, 24 are sector gears commonly provided to a gear member 27, which is rotatably supported by a first pivot 26 having an axis in parallel with the motor shaft 21 and provided to the carburetor main body 11. The driven gear 25 is formed as a sector gear as well.

Moreover, as one component, a cam 28 provided to the gear member 27, which is an operational member constituting a part of the throttle valve opening/closing mechanism 18, is included in the choke valve opening/closing mechanism 19. The choke valve opening/closing mechanism 19 is provided between the gear member 27 and the choke valve shaft 14*a* of the choke valve 14. The cam 28 is formed in the inner surface side of the gear member 27 around the first pivot 26.

Figure 4:
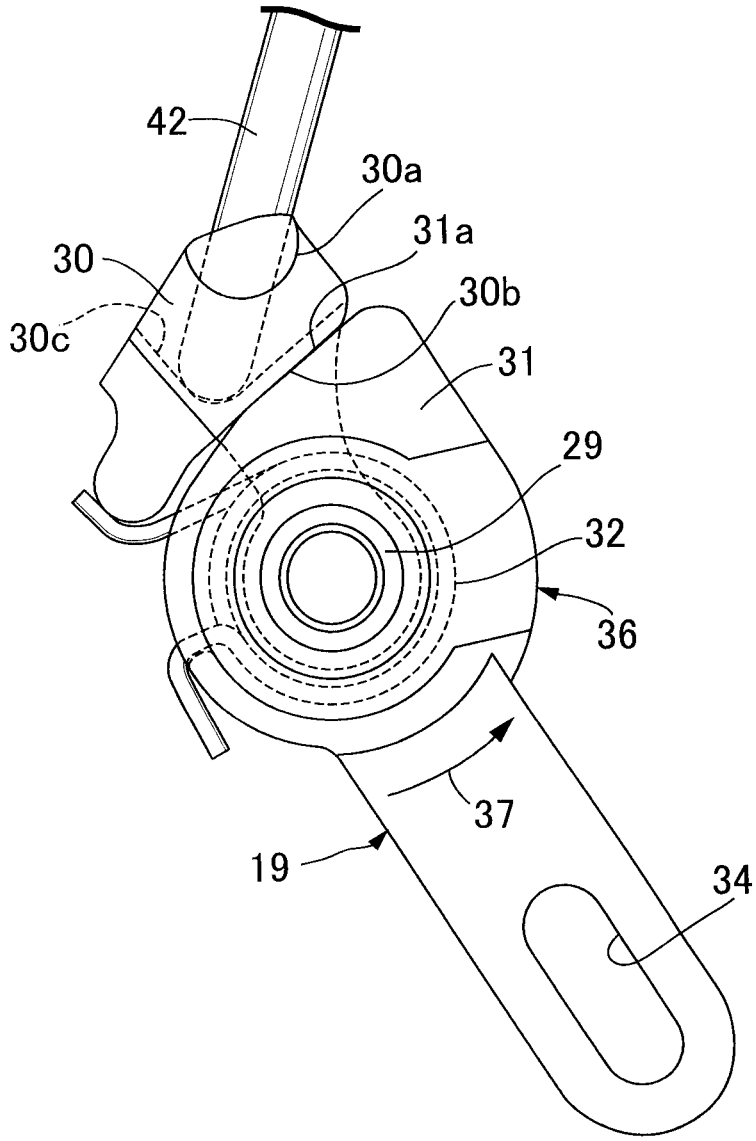
FIG. 4 is a view showing a part of a choke valve opening/closing mechanism which is seen in the same direction of FIG. 2.

Referring to FIGS. 2 and 4, the choke valve opening/closing mechanism 19 includes a cam follower 30, a first arm 31, a torsion spring 32 and a second arm 33. The cam follower 30 is rotatably supported by a second pivot 29, which has an axis in parallel with the first pivot 26 and which is provided to the carburetor main body 11. In addition, the cam follower 30 includes a cam slide-contact portion 30*a* which is in slide contact with the cam 28. A first end portion of the first arm 31 is rotatably supported by the second pivot 29. The torsion spring 32 is provided between a base end portion of the first arm 31 and the cam follower 30. The second arm 33 is fixedly attached to the choke valve shaft 14*a* and is linked and connected to a second end portion of the first arm 31.

The first arm 31 is formed in an elongated shape extending in a radial direction of the second pivot 29. An elongated hole 34, which extends long in the radial direction of the second pivot 29, is provided in the second end portion of the first arm 31. On the other hand, the second arm 33 is formed of a substantially V-shape in a way that an intermediate portion of the second arm 33 is rotatably supported by the second pivot 29. The first and second arms 31, 33 are linked and connected to each other by inserting a pin 35, which is provided in a first end portion of the second arm 33, in the elongated hole 34. Accordingly, the rotation of the first arm 31 about the axis of the second pivot 29 in an opening direction 37 (see FIG. 4), which is a counterclockwise direction in FIGS. 2 and 4, makes the second arm 33 rotate in a clockwise direction in FIGS. 2 and 4. Thereby, the choke valve 14 is rotatably driven toward an open side.

The cam follower 30 rotates in the counterclockwise direction about the axis of the second pivot 29 in FIG. 2 when the electric motor 17 operates the throttle valve 15 in a direction in which the throttle valve 15 rotates toward an open side; thus, the gear member 27 rotates in the counterclockwise direction in FIG. 2; and thereby, the cam slide-contact portion 30*a* comes into slide contact with the cam 28 provided to the gear member 27. The torsion spring 32 surrounding the second pivot 29 exerts a spring force which biases the cam follower 30 in a direction in which the cam slide-contact portion 30*a* comes into slide contact with the cam 28, that is to say, in the counterclockwise direction in FIG. 2, and thus rotatably biases the first arm 31 in the counterclockwise direction about the axis of the second pivot 29 in FIG. 2. The cam follower 30 and the first arm 31 are respectively provided with contact surfaces 30*b*, 31*a* which come into contact with each other due to the spring force exerted by the torsion spring 32.

For this reason, while in response to the rotation of the gear member 27, the cam follower 30 rotates in the counterclockwise direction in FIG. 2, the first arm 31 rotates following the cam follower 30 due to the spring force exerted by the torsion spring 32. While with the cam slide-contact portion 30*a* in slide contact with the cam 28, the first arm 31 rotates in the clockwise direction in FIG. 2, that is to say, in a direction in which the choke valve 14 opens, the first arm 31 alone rotates in the clockwise direction in FIG. 2.

Figure 3:
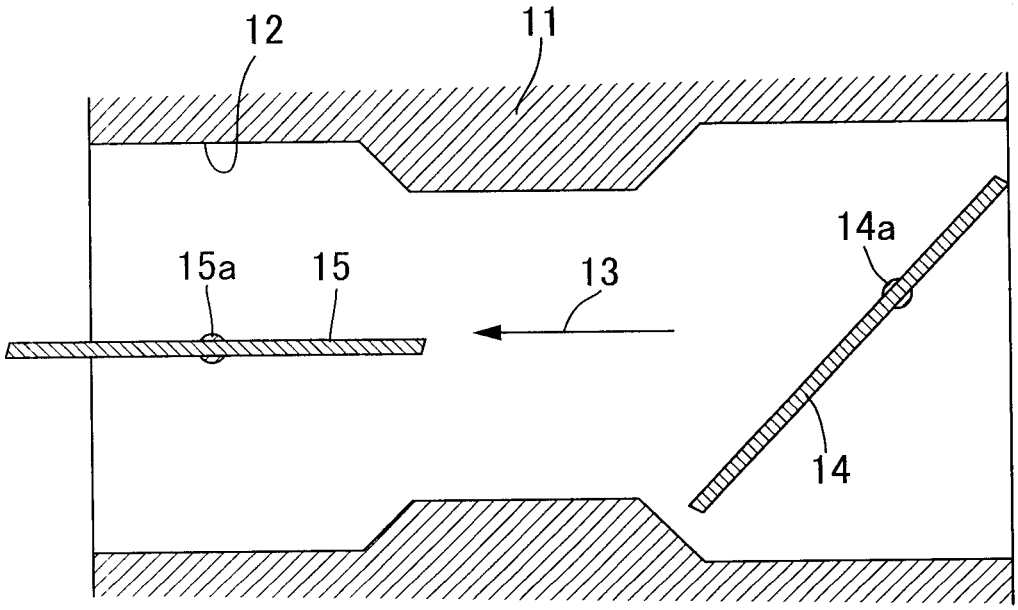
FIG. 3 is an enlarged cross-sectional view taken along a line 3-3 in FIG. 1.

Meanwhile, as clearly shown in FIGS. 2 and 3, the choke valve shaft 14*a* is placed in a location offset from the center of the air intake path 12 toward one side; and while fully closed, the choke valve 14 is put in a state of inclining to a center axis of the air intake path 12 in a way that a portion of the choke valve 14 that is larger in the radius of rotation is situated downstream of the other portion of the choke valve 14 which is smaller in the radius of rotation in the air intake path 12. For this reason, if an intake air pressure of the engine sharply increases and exceeds a predetermined value while the choke valve 14 is opened at a degree between the fully-closed position and a semi-opened position, the choke valve opening/closing mechanism 19 opens the choke valve 14 up to a position in which the difference between the rotation moment acting on the portion of the choke valve 14, which is larger in the radius of rotation, due to the intake air pressure and the rotation moment acting on the other portion of the choke valve 14, which is smaller in the radius of rotation, due to the intake air pressure comes to balance with the rotation moment generated by the torsion spring 32. In other words, the first arm 31 and the torsion spring 32 serve as a relief mechanism 36 for rotating the choke valve 14 toward an open side in accordance with the sharp increase in the load while the choke valve 14 is set between the fully-closed position and the semi-opened position.

Furthermore, a thermo-actuator 40 configured to operate in accordance with ambient temperature is accommodated in and fixed to the accommodation recess 16 of the carburetor main body 11. This thermo-actuator 40 is formed from a case 41 in which wax (not illustrated) is included, and a piston 42 projects from the case 41. The amount the piston 42 projects from the case 41 increases in accordance with the rise in the ambient temperature.

Moreover, a tip end portion of the piston 42 is capable of coming into contact with a pressure receiving portion 30*c* that is provided to the cam follower 30. The cam follower 30 rotates in the counterclockwise direction about the axis of the second pivot 29 in FIG. 2 according as the pressure receiving portion 30*c* is pressed by the piston 42. Thereby, independently of the choke valve opening/closing mechanism 19, the thermo-actuator 40 is capable of driving the choke valve 14 toward an open side.

A choke valve forcedly-closing device 43, which enables the choke valve 14 to be rotated toward a close side through its manual operation from outside the carburetor, is annexed to the carburetor main body 11. The choke valve forcedly-closing device 43 includes an operation lever 45 whose intermediate portion is rotatably supported by a third pivot 44 provided to the carburetor main body 11, a pressure receiving pin 46 with which a first end portion of the operation lever 45 is capable of coming in contact inside the accommodation recess 16, and which is provided to a second end portion of the second arm 33, and a return spring (not illustrated) provided between the carburetor main body 11 and the operation lever 45 in a way that makes the return spring bias the operation lever 45 in a direction in which the first end portion of the operation lever 45 is caused to come away from the pressure receiving pin 46. For this reason, when an operation force is applied to a second end portion of the operation lever 45 projecting out of the carburetor main body 11, the operation lever 45 brings its first end portion into contact with the pressure receiving pin 46 of the second arm 33, and is thereby capable of forcedly rotating the second arm 33 in the counterclockwise direction in FIG. 2, that is to say, in a direction in which the choke valve 14 closes.

Figure 5:
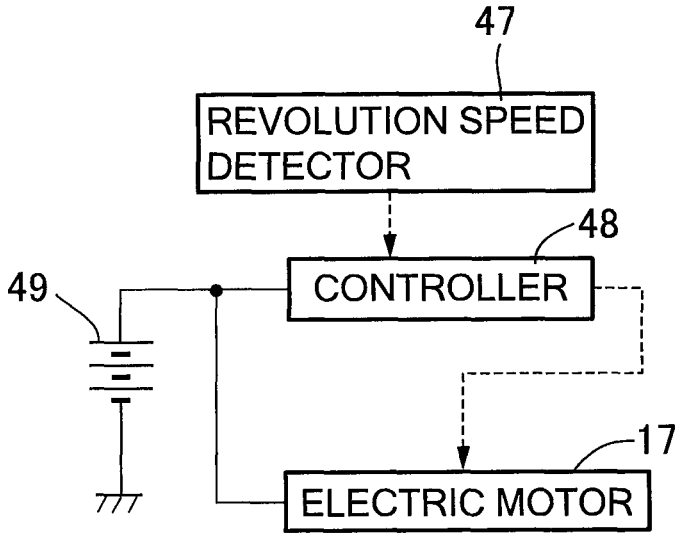
FIG. 5 is a diagram showing a configuration of a control system.

In FIG. 5, the operation of the electric motor 17 is controlled by a controller 48 on the basis of a value detected by revolution speed detector 47 for detecting the condition of revolutions of the engine. A battery 49 supplies an electric power to the controller 48 and the electric motor 17.

Figure 6:
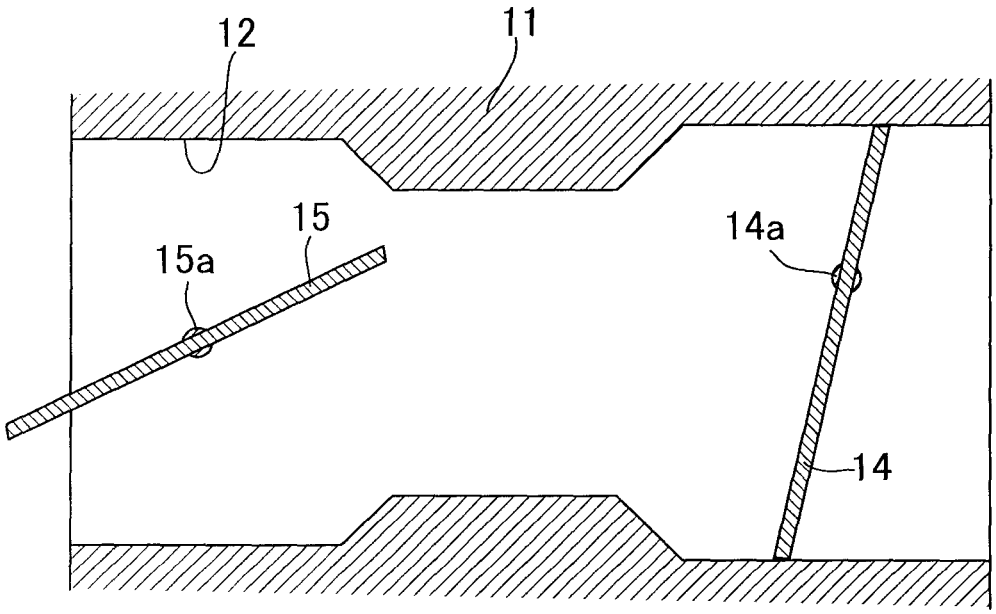
FIG. 6 is a sectional view when the engine starts to be cranked, and corresponds to FIG. 3.
Figure 7:
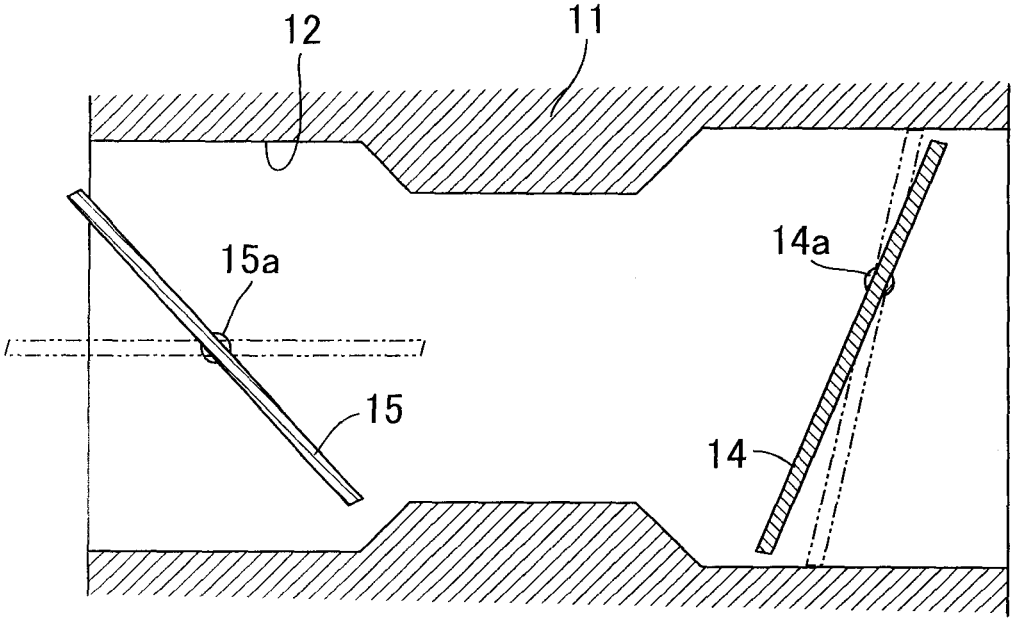
FIG. 7 is a sectional view while the engine is being warmed up, and corresponds to FIG. 3.

The cam 28 is formed in a way that when the engine is stopped, the controller 48 controls the operation of the electric motor 17, and thereby operates the throttle valve opening/closing mechanism 18 and the choke valve opening/closing mechanism 19 in order that, as shown in FIGS. 2 and 3, the throttle valve 15 is set in the fully-opened position, while the choke valve 14 is set in the semi-opened position. When the engine starts to be cranked, the controller 48 controls the operation of the electric motor 17, and thereby operates the throttle valve opening/closing mechanism 18 and the choke valve opening/closing mechanism 19 in order that, as shown in FIG. 6, the throttle valve 15 is set in an over fully-opened position, while the choke valve 14 is set in the fully-closed position. While the engine being warmed up, the controller 48 controls the operation of the electric motor 17, as well as thereby operates the throttle valve opening/closing mechanism 18 in order that, as shown in FIG. 7, the opening degree of the throttle valve 15 is made variable, and the operation of the choke valve opening/closing mechanism 19 in conjunction with the operation of the throttle valve opening/closing mechanism 18 makes the choke valve 14 rotate between the fully-closed position and the semi-opened position in accordance with the opening degree of the throttle valve 15.

Next, descriptions will be provided for how the embodiment works. The controller 48, to which the battery 49 supplies the electric power, operates the electric motor 17 and the choke valve opening/closing mechanism 19 in order that when the engine is stopped, the choke valve 14 is set in the semi-opened position and, when the engine starts to be cranked, the choke valve 14 is set in the fully-closed position. For this reason, even if the choke valve shaft 14*a* of the choke valve 14 freezes up while the engine is being stopped, the amount of air does not become smaller than needed immediately after the engine is started, and the engine stall is avoided. Accordingly, the marketability can be enhanced.

In addition, the use of the choke valve forcedly-closing device 43 enables the choke valve 14 to be rotated toward a close side through the manual operation from outside the carburetor. For this reason, even if the choke valve shaft 14*a* of the choke valve 14 freezes up with the choke valve 14 semi-opened, the choke valve shaft 14*a* can be released from its freeze-up condition by forcedly rotating the choke valve 14 toward a close side.

Besides, the throttle valve opening/closing mechanism 18 for opening and closing the throttle valve 15 in accordance with the operation of the electric motor 17 is provided between the electric motor 17 and the throttle valve 15. The choke valve opening/closing mechanism 19 includes, as one component, the cam 28 provided to the gear member 27 constituting a part of the throttle valve opening/closing mechanism 18, and is provided between the gear member 27 and the choke valve 14. For these reasons, the electric motor 17 can be commonly used between the throttle valve opening/closing mechanism 18 and the choke valve opening/closing mechanism 19. Accordingly, it is possible to reduce the parts in number, and to build the automatic choke apparatus in a compact size.

In addition, the cam 28 of the choke valve opening/closing mechanism 19 is formed in a way that makes the choke valve 14 operate between the fully-closed position and the semi-opened position in accordance with the opening degree of the throttle valve 15 while the engine is being warmed up. For this reason, the engine can be started in a satisfactory condition by matching the opening degree of the choke valve 14 with the opening degree of the throttle valve 15 while the engine is being warmed up.

Figure 8:
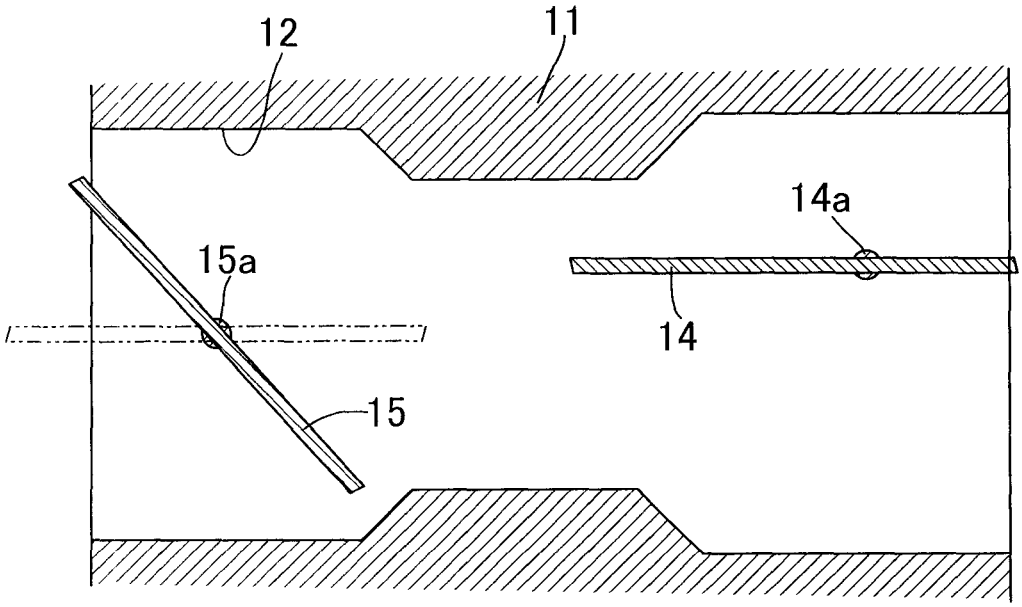
FIG. 8 is a sectional view when the engine warm-up is completed, and corresponds to FIG. 3.

Furthermore, the choke valve 14 is driven toward an open side in accordance with the ambient temperature by the thermo-actuator 40, which operates independently of the choke valve opening/closing mechanism 19, and while the warm-up is completed, the choke valve 14 is held in the fully-opened state, as shown in FIG. 8. For this reason, the engine can be started in accordance with the external environment by adjusting the opening degree of the choke valve 14 in accordance with the ambient temperature.

Moreover, if the load sharply increases while the choke valve 14 is set between the fully-closed position and the semi-opened position with the engine put in the warm-up condition, the air-to-fuel ratio can be adjusted in accordance with the load by making the choke valve 14 rotate toward an open side in conjunction with the working of the relief mechanism 36.

An embodiment of the present invention is explained above, but the present invention is not limited to the above-mentioned embodiment and may be modified in a variety of ways as long as the modifications do not depart from its gist.

What is claimed is:

1. An automatic choke apparatus for a carburetor, comprising:

an electric actuator;

a choke valve opening/closing mechanism configured to open and close a choke valve by being driven by a power exerted by the electric actuator; and a controller configured to control operation of the electric actuator, wherein the automatic choke apparatus further comprises a battery configured to supply electric power to the controller and the electric actuator, the controller operates the electric actuator and the choke valve opening/closing mechanism in order that: the choke valve is set in a semi-opened position when an engine is stopped; and the choke valve is set in a fully-closed position when the engine starts to be cranked, the automatic choke apparatus further comprises a throttle valve opening/closing mechanism configured to open and close a throttle valve in accordance with operation of the electric actuator, and provided between the electric actuator and the throttle valve, the choke valve opening/closing mechanism includes, as one component, a cam provided to an operation member constituting a part of the throttle valve opening/closing mechanism, and disposed between the operation member and the choke valve, and the cam is formed in order that while the engine is being warmed up, the choke valve is operated between the fully-closed position and the semi-opened position in accordance with an opening degree of the throttle valve.

2. The automatic choke apparatus for a carburetor according to claim 1, further comprising a thermo-actuator configured to drive the choke valve toward an open side in accordance with ambient temperature independently of the choke valve opening/closing mechanism.

3. The automatic choke apparatus for a carburetor according to claim 1, further comprising a relief mechanism configured to rotate the choke valve toward an open side in accordance with a sharp increase in load while the choke valve is between the fully-closed position and the semi-opened position.

4. The automatic choke apparatus for a carburetor according to claim 1, further comprising a choke valve forcedly-closing device that enables the choke valve to be rotated toward a close side through manual operation from outside the carburetor.

5. The automatic choke apparatus for a carburetor according to claim 2, further comprising a relief mechanism configured to rotate the choke valve toward an open side in accordance with a sharp increase in load while the choke valve is between the fully-closed position and the semi-opened position.

6. The automatic choke apparatus for a carburetor according to claim 2, further comprising choke valve forcedly-closing device that enables the choke valve to be rotated toward a close side through manual operation from outside the carburetor.

7. The automatic choke apparatus for a carburetor according to claim 3, further comprising choke valve forcedly-closing device that enables the choke valve to be rotated toward a close side through manual operation from outside the carburetor.

8. An automatic choke apparatus for a carburetor, comprising:

an electric actuator;

a choke valve opening/closing mechanism configured to open and close a choke valve by being driven by a power exerted by the electric actuator; and a controller configured to control operation of the electric actuator, wherein the automatic choke apparatus further comprises a battery configured to supply electric power to the controller and the electric actuator, the controller operates the electric actuator and the choke valve opening/closing mechanism in order that: the choke valve is set in a semi-opened position when an engine is stopped; and the choke valve is set in a fully-closed position when the engine starts to be cranked, and the automatic choke apparatus further comprises a choke valve forcedly-closing device that enables the choke valve to be rotated toward a close side through manual operation from outside the carburetor.

* * * * *